US006243873B1

(12) United States Patent
Aliff

(10) Patent No.: US 6,243,873 B1
(45) Date of Patent: Jun. 12, 2001

(54) RAIN WRAP GARMENT

(76) Inventor: Karla T. Aliff, 5137 Dueling Oaks, Marrero, LA (US) 70072

( * ) Notice: Subject to any disclaimer, the term of this patent is extended or adjusted under 35 U.S.C. 154(b) by 0 days.

(21) Appl. No.: 09/607,554

(22) Filed: Jun. 29, 2000

(51) Int. Cl.[7] ..... A41D 3/08
(52) U.S. Cl. ..... 2/88; 2/84; 2/87
(58) Field of Search ..... 2/84, 85, 87, 88, 2/89, 93, 69.5, 69, 108, 94, 82; 383/4; 190/1; 5/485, 484, 494, 502; 224/575, 577

(56) References Cited

U.S. PATENT DOCUMENTS

| | | | | |
|---|---|---|---|---|
| 2,024,044 | * | 12/1935 | Johnson | 2/88 |
| 2,462,269 | * | 2/1949 | Krempel | 2/84 |
| 3,522,612 | * | 8/1970 | Palmer | 2/88 |
| 3,835,471 | * | 9/1974 | Lankford | 2/84 |
| 4,060,852 | * | 12/1977 | Meeks | 2/84 |
| 4,078,264 | * | 3/1978 | DeGennaro et al. | 2/88 |
| 4,301,547 | * | 11/1981 | Bloise | 2/88 |
| 5,463,783 | * | 11/1995 | Pope | 2/88 |
| 5,664,258 | | 9/1997 | Harris . | |
| 5,855,021 | | 1/1999 | Somerville . | |
| 5,875,492 | | 3/1999 | Moss . | |
| 5,884,331 | * | 3/1999 | Barajas | 2/88 |
| 5,901,375 | * | 5/1999 | Davis | 2/84 |
| 5,946,723 | * | 9/1999 | DiPrato et al. | 2/88 |

* cited by examiner

*Primary Examiner*—Amy B. Vanatta
(74) *Attorney, Agent, or Firm*—Henderson & Sturm LLP

(57) ABSTRACT

A rain wrap garment including a flat flexible fabric panel having a water repellant side and a water absorbing terry-cloth side. A hood is attached to the top edge of the panel and is selectively storable in a hood pocket centrally located at the top edge. A storage pocket is located at one of the side edges and is disposed to receive and store the panel when folded to conform with the dimensions of the storage pocket. A shoulder strap is attached to the storage pocket near its opening and is used to carry the rain wrap garment when it is in the folded stored position.

4 Claims, 3 Drawing Sheets

RAIN WRAP GARMENT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of rain gear, and more particularly to a rain wrap garment.

2. Description of Related Art

As can be seen by reference to the following U.S. Pat. Nos. 5,664,258; 5,855,021; and 5,875,492, the prior art is replete with myriad and diverse rain gear designs.

While all of the aforementioned prior art constructions are more than adequate for the basic purpose and function for which they have been specifically designed, they are uniformly deficient with respect to their failure to provide a simple, efficient, and practical rain wrap garment.

As a consequence of the foregoing situation, there has existed a longstanding need for a new and improved rain wrap garment and the provision of such a construction is a stated objective of the present invention.

BRIEF SUMMARY OF THE INVENTION

Briefly stated, the present invention provides a rain wrap garment including a flat flexible fabric panel having a water repellant side and a water absorbing side. A hood is attached to the top edge of the panel and is selectively storable in a hood pocket centrally located at the top edge. A storage pocket is located at one of the side edges and is disposed to receive and store the panel when folded to conform with the dimensions of the storage pocket. A shoulder strap is attached to the storage pocket near its opening and is used to carry the rain wrap garment when it is in the folded stored position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
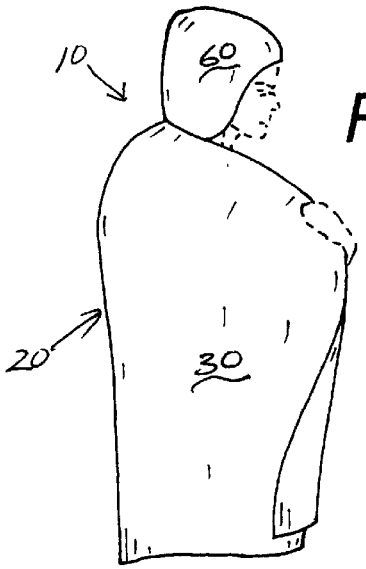
FIG. 1 is a perspective view showing the rain wrap garment in use with the hood in the open position.
Figure 2:
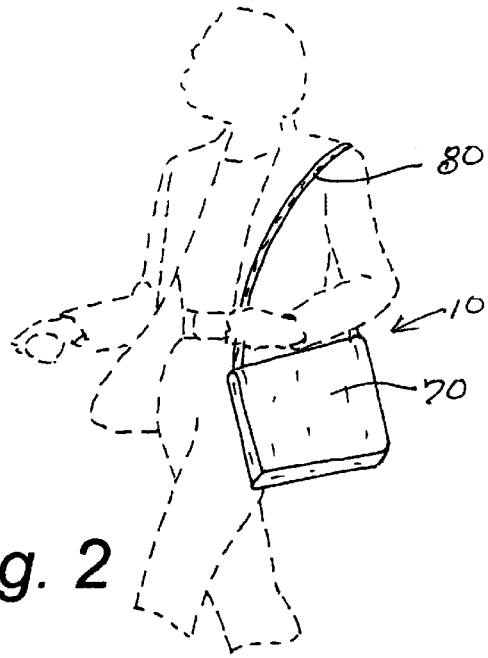
FIG. 2 is a perspective view showing the rain wrap garment being carried in the stored position.
Figure 3:
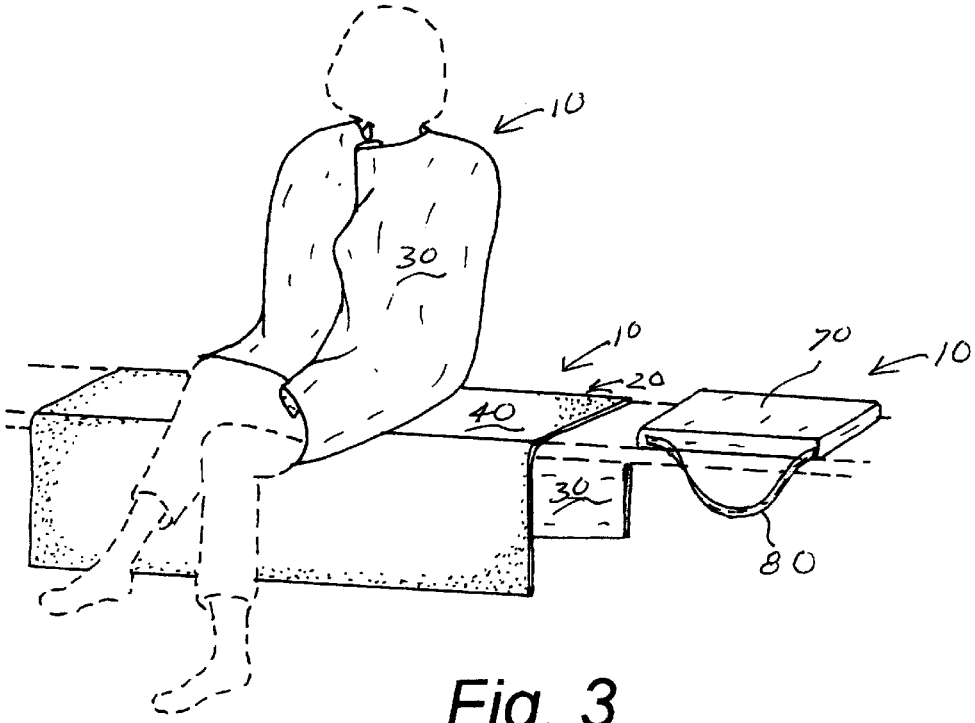
FIG. 3 is a perspective view showing three rain wrap garments, one being used by an individual with the hood in the stored position, a second being used to cover a stadium bench seat, and a third where the garment is in the stored position and can be used as a seat cushion.
Figure 4:
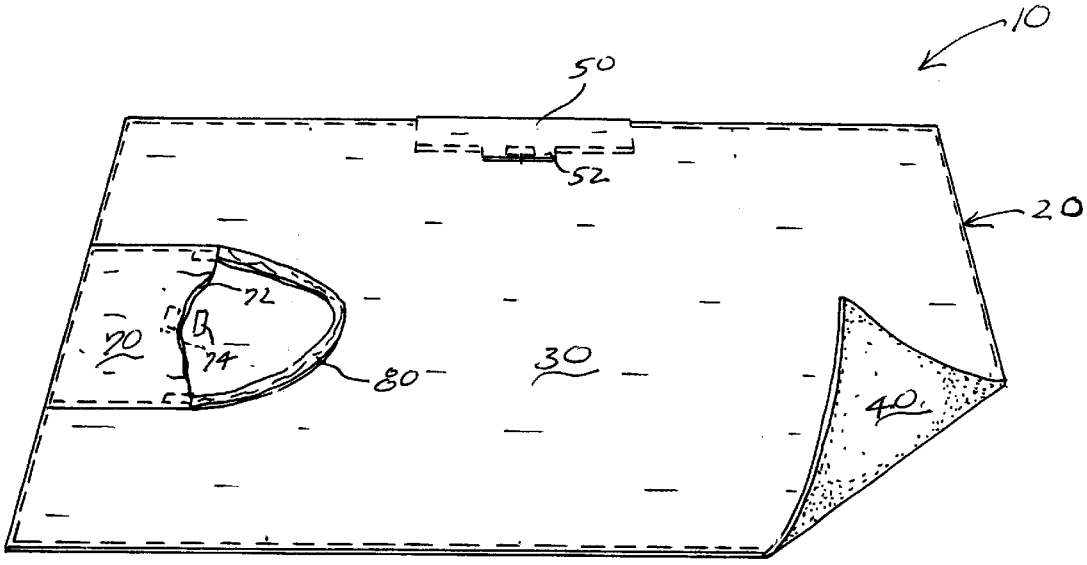
FIG. 4 is a perspective view of the rain wrap garment laid flat with the water repellant side up.
Figure 5:
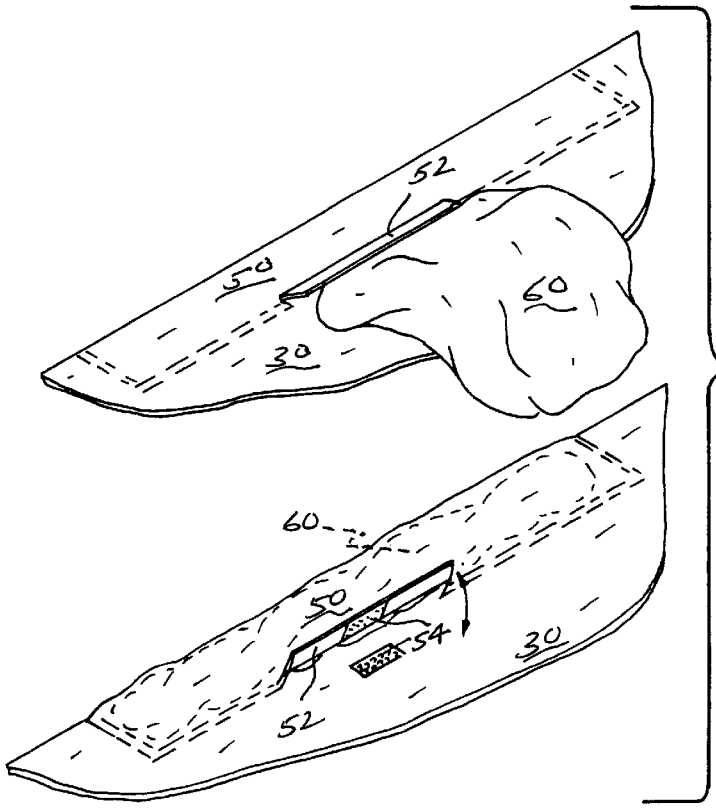
FIG. 5 is a partial perspective view, the top portion illustrating the hood pocket with the hood in the open position, and the bottom portion illustrating the hood in the stored position within the hood pocket.
Figure 6:
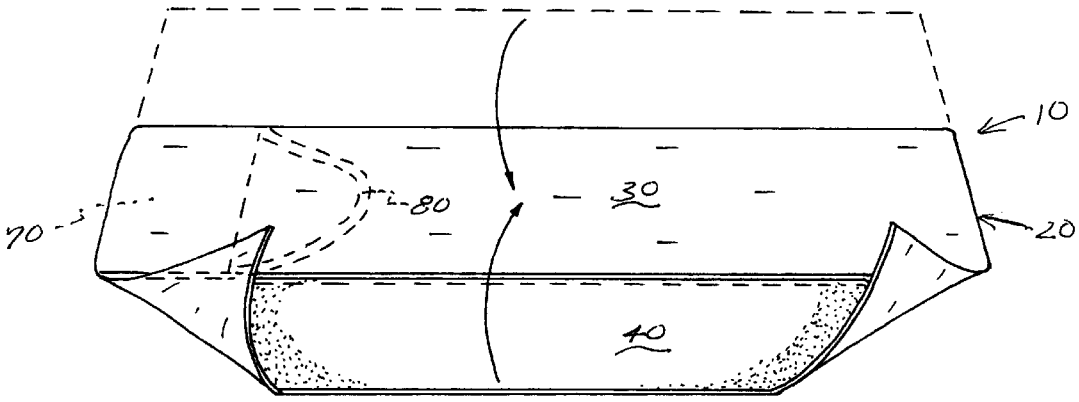
FIG. 6 is a perspective view illustrating the rain wrap garment being folded to prepare it for storage in the storage pocket.
Figure 7:
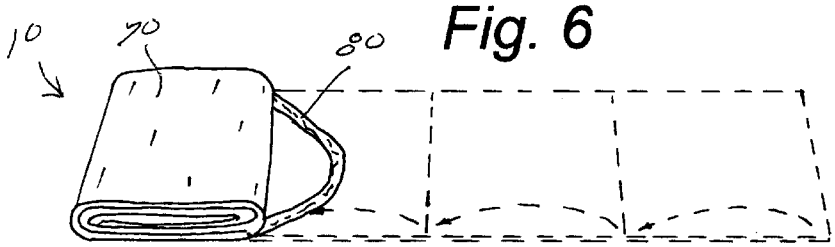
FIG. 7 is a perspective view illustrating the rain wrap garment in the stored position.
Figure 8:
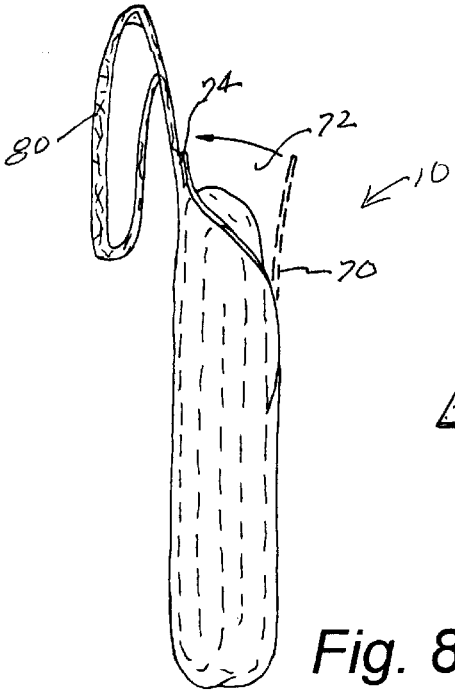
FIG. 8 is a side elevational view showing the operation of the sealable opening of the storage pocket.
Figure 9:
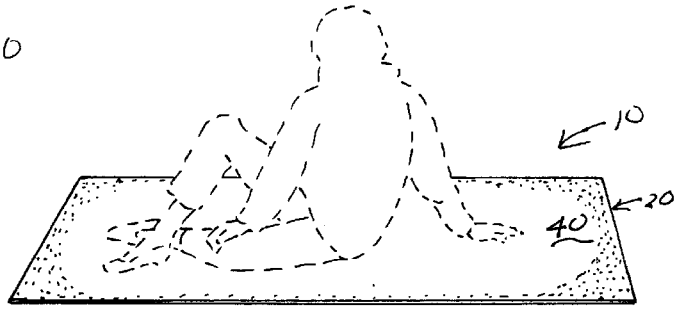
FIG. 9 is a perspective view showing the rain wrap garment being used as a picnic throw.

As can be seen by reference to the drawings, and in particularly to FIG. 1, the rain wrap garment that forms the basis of the present invention is designated generally by the reference number 10. As most clearly shown in FIG. 4, the rain wrap garment 10 includes two flat pieces of fabric sewn together and top stitched across the surface to form a flat flexible fabric panel 20. The panel 20 includes a water-repellant side 30 and a water absorbing terrycloth side 40. On the water-repellant side 30 at the center of the top edge is a hood pocket 50 that has a flap 52 that is selectively sealable by hook and loop fasteners 54. A hood 60 is attached to the water-repellant side 30 adjacent the hood pocket flap 52 and is movable between a stored position within the hood pocket 50, as shown in the lower part of FIG. 5, and an open position, as shown in the upper part of FIG. 5.

On the water-repellant side 30 centered on the left side edge (FIG. 4) is a storage pocket 70 with an opening 72 selectively sealable by hook and loop fasteners 74. A shoulder strap 80 is attached to the storage pocket 70 near the sides of the sealable opening 72. The fabric panel 20 is movable between a folded stored position within the storage pocket 70 and an open position disposed exterior of the storage pocket 70.

The rain wrap garment 10 has a variety of uses including an alternative to an umbrella, a towel, a stadium wrap with or without the hood, a stadium seat cover, a seat cushion, a picnic throw, and others. The rain wrap garment 10 can be held over the head, or draped over the head. This is how it is used when in a hurried situation, such as going from a building to a vehicle. When in a stadium or sports event, it can be wrapped around the shoulders and the hood 60 can be used or left in the stored position. When in use, it drapes around the body giving the arms and body more protection from the rain than an umbrella. It is a quick and easy solution to a wet problem.

When using the rain wrap garment 10 going from a building to a car, it is quick and easy to get into the car and close the door, then it is simply lifted up over the head and onto the back of the cart seat. There is no struggling with anything while the car door is opened, as with an umbrella. This is when one tends to get even more wet. Also, it eliminates having to pull in the wet umbrella across the user's lap into the car. If a person does get wet, the inside is terrycloth which provides a towel to dry off.

Persons using public transportation can use the rain wrap garment 10. It is easily taken along on a rainy day, it is light and has a convenient carrying strap 80. When getting into a bus, streetcar or taxi one must first close an umbrella before entering. With the garment 10 one can walk in without having to uncover oneself. The same for exiting, one must step out into the rain before opening an umbrella. With the garment 10, one would have it on and be protected as one steps out of the bus into the rain.

The garment 10 also is a safe and courteous rain gear in a stadium setting since there is no blocking of the view of the person behind the user. It comfortably wraps around the individual and is long enough behind that if the seat is wet it also is covered. The hood 60 that is in the hood pocket 50 can be used if desired. If it is not raining but the seat is wet, the terrycloth side 40 can be used to wipe the seat dry or the garment 10 may be unfolded on the water-repellant side 30 faced down. Another option would be to leave the garment 10 in the storage pocket 70 and use it as a seat cushion wet or dry. The rain wrap garment 10 can be kept in a car for trips to a park or playground. It is a convenient picnic throw that provides a clean, dry place to sit, or a soft place for an infant child to lay. Also, students on a college campus can use the garment 10. It is easily taken along on a rainy day. It will cover the body and the book sack while the student walks from building to building.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A rain wrap garment, comprising:

a flat flexible fabric panel having a top edge, a bottom edge, and side edges, the panel including a water-repellant side and a water absorbing side;

a hood pocket disposed on the water-repellant side centrally located at the top edge, the hood pocket including a selectively sealable flap;

a hood attached to the water-repellant side of the panel adjacent the hood pocket flap, the hood being selectively movable between a stored position within the hood pocket and an open position disposed exterior of the hood pocket; and a storage pocket disposed on the water-repellant side centrally located at one of the side edges, the storage pocket including a selectively sealable opening, the panel being movable between a folded stored position within the storage pocket and an open position disposed exterior of the storage pocket.

2. The rain wrap garment of claim 1 further including a shoulder strap attached to the storage pocket adjacent the sealable opening.

3. The rain wrap garment of claim 1 wherein the water absorbing side is terrycloth.

4. The rain wrap garment of claim 2 wherein the water absorbing side is terrycloth.

* * * * *